United States Patent [19]

Rausch

[11] 4,054,167

[45] Oct. 18, 1977

[54] CASE FOR PHOTOGRAPHIC CAMERAS

[75] Inventor: Günter Rausch, Braunschweig, Germany

[73] Assignee: Rollei-Werke Franke & Heidecke, Braunschweig, Germany

[21] Appl. No.: 701,992

[22] Filed: July 1, 1976

[30] Foreign Application Priority Data

July 11, 1975 Germany ..... 7522008[U]

[51] Int. Cl.[2] ..... G03B 29/00

[52] U.S. Cl. ..... 150/52 J

[58] Field of Search ..... 150/52 J; 354/75, 76, 354/288

[56] References Cited

U.S. PATENT DOCUMENTS 3,037,541 6/1962 Hohmuth ..... 150/52 J

FOREIGN PATENT DOCUMENTS 1,199,397 6/1959 France ..... 150/52 J

*Primary Examiner*—Donald F. Norton

*Attorney, Agent, or Firm*—Ralf H. Siegemund

[57] ABSTRACT

The flap of the case has a frustoconical extension for receiving the lens, but when empty, the extension is folded inwardly by bending at the seam with the flap proper, and by folding about two score lines.

6 Claims, 5 Drawing Figures

CASE FOR PHOTOGRAPHIC CAMERAS

BACKGROUND OF THE INVENTION

The present invention relates to a case for photographic cameras particularly of the type with a rather far projecting objective lens, for example, a camera of the single lens reflex type.

Cases for SLR cameras are usually constructed to have a basic body with a flap having tubular projection which encases the projecting objective lens. Such an objective lens is usually of the exchangeable variety and not structually incorporated in the camera. For this reason, such a lens and its connecting and locking structure, connecting it to the camera, is endangered as regards impacts and other damage. Thus, the cases, and particularly the flap, must be constructed particularly strong and stiff. Such a case has the disadvantage that it occupies a considerable volume when empty. Therefor, as such cases are made and shipped, empty of course, they occupy a large volume of space.

It has been suggested to construct a case in that projecting portions are folded back for insertion in the main cavity of the case. A partially collapsible camera case is also described in German printed patent application No. 21 16 244. This case has at least two rather soft sides which fold inwardly, for instance into the projecting portion, so that the latter can then be folded or pushed into the main body of the case. The case, however, has the disadvantage that most of its projecting portion is made of soft material and does not sufficiently protect a lens therein.

Aside from inadequate protection afforded by the known foldable camera cases, they have the additional disadvantage that they look rather crushed and wrinkled soon after used in that manner.

DESCRIPTION OF THE INVENTION

It is an object of the present invention to provide a new and improved camera case which permits reduction of its volume without, however, compromising on the stiffness needed for affording adequate protection of its content.

It is another object of the present invention to provide a new and improved camera case having a foldaway portion but without leaving visible evidence of foldability when deployed.

In accordance with the preferred embodiment of the present invention, it is suggested to provide the frustoconical extension of a flap of a camera case with a folding zone defined by two parallel running score lines circumscribing the extension, and to provide a bending zone where the extension projects from the flap proper so that the front portion of the extension can be shifted into the rear portion thereof, while the latter is inverted and folded into the camera case. This way, the extension (of course, with no camera in the case) can, in fact, be folded into the body of the case thereby reducing considerably the volume of the case as a whole when empty. The distance between folding zone and bending zone at the flap should be about equal to the internal depth of the camera case body so that the rear portion of the extension can be entirely stored in the case body.

The two score lines should be spaced from each other by a distance at least approximately equal to or a little larger than three times the material thickness of the flap extension. This way, sharp fold lines will not form, and the folded out extension does not reveal its foldability, e.g. by ugly looking creases. The folding in the folding zone is produced by curving the material along a rather large radius.

The score lines may be defined by carved (milled) in grooves. The flap may consist of an outer skin, an inner lining, and a filler. The latter has preferably gaps adjacent to the score lines and either the skin or the lining or both have score lines depending upon which is made of the stiffer material.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a camera case 1 having a main body 2 and a fold-over flap 4 with an extension for encasing a projecting objective lens of a camera. This flap 4 has a frustoconical extension 3 which is folded-in, thereby reducing the overall volume of the case considerably. The conical extension has a folding zone 5 in which the wall is folded twice in the same direction, and by 90° in each instance, so that almost the entire extension is received by the interior of the case's body.

Figure 1:
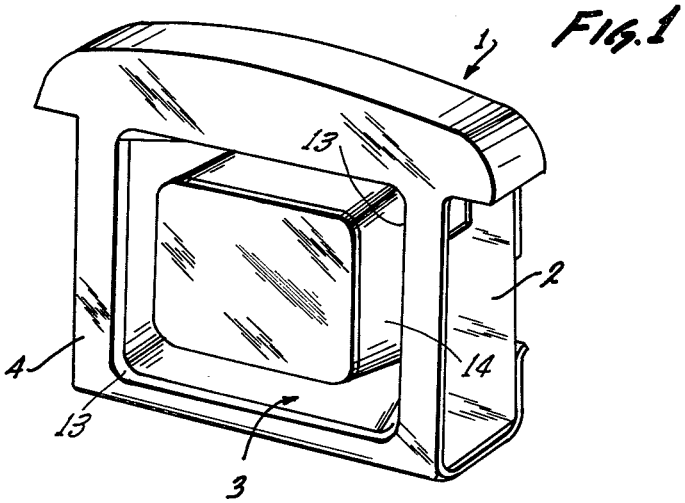
FIG. 1 is a perspective view of a camera case in accordance with the preferred embodiment of the present invention, showing a folded-in extension.

The tubular extension of the flap is established by a front portion 14 and a larger rear portion 15 connected to the flap 4 by a seam 13, which permits easy bending of portion 15 about the rim of flap 4 to which portion 15 is sewn. The two portions 14 and 15 are, of course, of integral construction but there are two score lines 6 and 7 in the integral tube to thereby permit bending of parts 14 and 15 relative to each other. These lines 6 and 7 are grooves or the like, as will be described shortly.

Figure 2:
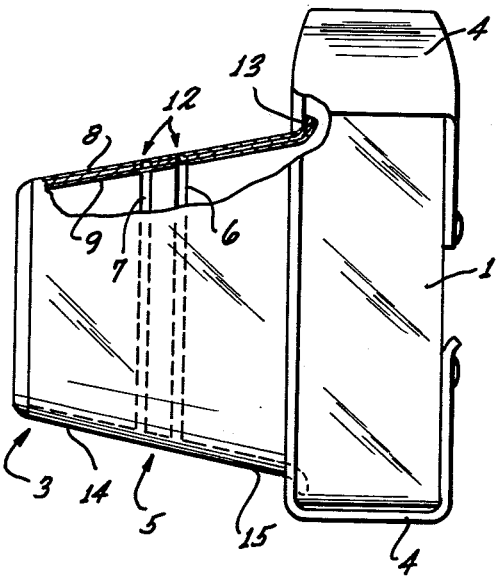
FIG. 2 is a partial cross section of the case but with projecting extension.
Figure 3:
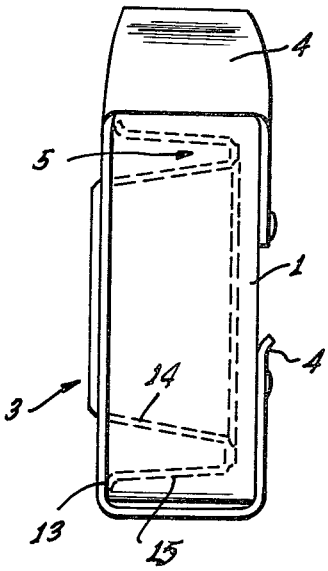
FIG. 3 is a similar cross section but with folded-in extension.

The extension protracts as shown in FIG. 2. For folding one simply presses front part 14 towards the case so that material bends inwardly along lines 6 and 7. This permits part 14 to be shifted partially into the rear part 15, followed by inside-out folding of part 15 by means of bending around seam 13, whereby part 14 now becomes completely inserted in part 15.

It can be seen that score lines 6 and 7 are located so that at least almost the entire projecting part 3 can be folded-in. From a different point of view, the distance between the bending zone of seam 13, and the folding zone 5 (axial length of portion 15) should be about equal to the inner depth of the case body so that portion 15 can be fully inserted in the case. If the axial length of both portions, 14 and 15, together is less than twice the depth of the case, then the folding zone should be located half way between the front end of the extension and seam 13.

The score lines 6 and 7 are grooves which thin the material and extend parallel to each other all around the inner periphery of the frustoconical extension 3. The case and particularly the tubular extension 3 is made of an outer skin 8 (leather or the like), an inner lining 9 (leather or cloth) and stiffening inserts or fillers 10 made, e.g. of hard plastic scrap leather or the like. The grooves or score lines 6 and 7 are worked into the stiffest and strongest material of these three layers which may be either one of them. If the outer skin and the inner lining are made of the same material and of equal thickness, the groove may be worked in both of them. This way, folding and bending occurs at these grooves only and with certainty.

Figure 4:
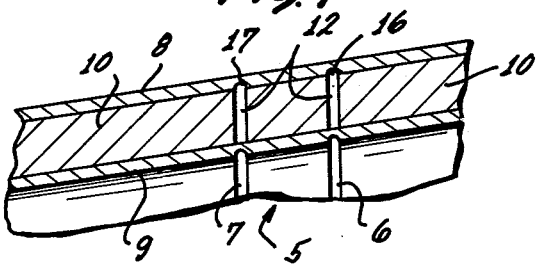
FIG. 4 is an enlarged section view of a portion of FIG. 2.
Figure 5:
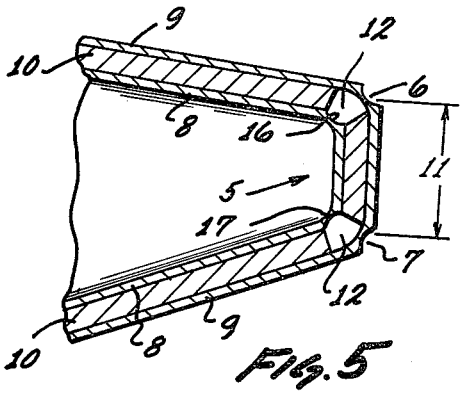
FIG. 5 is an enlarged section view of the same portion but in folded-in position as per FIG. 3.

The bending zone is depicted in FIGS. 4 and 5 showing it greatly enlarged. In particular, the inner skin has grooves or score lines 6 and 7, and the other skin has also score lines or grooves, 16 and 17, respectively, registering with the grooves 6 and 7. The stiffening inserts and fillers 10 have gaps 12 in the same zone. All these features contribute to ready bending and folding of and in this zone. However, the stiffening inserts are readily effective to take up impact forces including frontal ones, because the groove and gap pattern provides only a very limited axial yield, and when the stiffening inserts 10 are shifted axially and against each other, they will react in unison and provide the needed protection. A lateral impact is taken up as usual; the folding zone 5 does not change that capability at all.

It was outlined above that the bending or folding zone 5 should not be visible, particularly when the extension projects in normal use of the case. Thus, the outer skin should not be deformed anywhere. This is accomplished, first of all, in that the grooves 16 and 17 of the outer skin are carved in on the inside and are, thus, not visible. Additionally, the two score lines 16 and 17 are spaced by a distance 11, which is at least equal to three times the material thickness of the three superimposed layers. Also, due to the inward folding of the outer skin 8 of part 15, it locates on the inside and its outer surface is not subject to tension (see FIG. 5). The skin follows a rather large overall radius of curvature in the folding zone 5. This way, no sharp folds, creases etc. are developed and the appearance of the case does not suffer.

In order to provide the score lines one may mill cut, e.g. grooves into e.g. leather, by reducing its thickness to about 70 to 60%. Plastic or woven linings require different techniques, e.g. notched welding seams or double round seams in the case of woven material. The particular method of groove cutting and its depth depends also to some extent on the inserted material 10. In any event, the main purpose of grooves and gaps is to establish a define zone for double bending so that upon pushing tube 3 inwardly, it will fold gently at great curvature and in definite locations.

As was mentioned above, not all of the layers need to have grooves. If the inner lining is of soft flexible material, it does not need grooves. Upon using a filler layer 10, gaps or deep grooves should be provided because the filler may be quite stiff and should not break.

The invention is not limited to the embodiments described above but all changes and modifications thereof not constituting departures from the spirit and scope of the invention are intended to be included.

I claims:

1. Case for photographic cameras, with projecting objective lens, having a body and a flap with a conical extension having internal access for receiving the objective lens, comprising:

two parallel running score lines defining a folding zone and extending around the extension of the flap, dividing the extension into a frontal and a rear portion; and a closed loop bending zone between the rear portion of the extension and the flap for inward bending of the rear portion so that the extension can be folded into the case, by shifting the frontal portion into the rear portion and inverting the rear portion.

2. Case as in claim 1, wherein said two lines are spaced by a distance being at least three fold the thickness of the material of the flap extension.

3. Case as in claim 1, wherein the extension has an outer skin, an inner lining and stiffening filling material in between the skin and the lining, the filling material having gaps in adjacents the score lines, the score lines being grooves in at least one of the skin and the lining.

4. Case as in claim 1, said folding zone being spaced from the bending zone by a distance about equal to an internal depth of the case body.

5. Case as in claim 1, wherein the extension is made of an outer skin and of an inner lining, the score lines being in the thicker one of the skin and the lining.

6. Case as in claim 1, wherein the extension is made of an outer skin and of an inner lining, there being registering score lines in the outer skin and the inner lining.

* * * * *